US007222372B1

(12) United States Patent
Bruckart et al.

(10) Patent No.: US 7,222,372 B1
(45) Date of Patent: May 29, 2007

(54) METHOD AND APPARATUS FOR SECURING A TEE SHIRT TO A BRA

(76) Inventors: Debra A. Bruckart, 3140 Coventry St., Deltona, FL (US) 32738; David B. Bruckart, 3140 Coventry St., Deltona, FL (US) 32738

( * ) Notice: Subject to any disclaimer, the term of this patent is extended or adjusted under 35 U.S.C. 154(b) by 247 days.

(21) Appl. No.: 10/670,007

(22) Filed: Sep. 24, 2003

(51) Int. Cl.
*A41D 1/18* (2006.01)
*A41C 3/00* (2006.01)

(52) U.S. Cl. ..... 2/106; 450/1

(58) Field of Classification Search ..... 2/104–106, 2/107, 125, 126, 74, 49.1, 113–115, 270, 2/69, 50–52, 920, 95, 80, 90, 289, 321, 311, 2/312, 317, 170, 171, 336, 339, DIG. 11, 2/921; 24/306, 442, 707.05; 223/1; 450/1, 450/86, 87, 88, 7–11, 14–17, 28, 30, 31, 32
See application file for complete search history.

(56) References Cited

U.S. PATENT DOCUMENTS 4,612,935 A 9/1986 Greifer
4,858,249 A 8/1989 Stewart
4,953,233 A 9/1990 Moshier
5,060,348 A 10/1991 Moshier
5,914,166 A 6/1999 Le
6,068,538 A 5/2000 Alleyne
6,081,925 A * 7/2000 Reiber ..... 2/125
6,146,239 A * 11/2000 Magliocchetti ..... 450/1
6,175,961 B1 * 1/2001 Linden et al. ..... 2/125
6,240,560 B1 * 6/2001 DeCaro ..... 2/67
6,272,691 B1 8/2001 Henricksen et al.
6,427,244 B1 * 8/2002 Speier et al. ..... 2/104

* cited by examiner

*Primary Examiner*—Gloria M. Hale
(74) *Attorney, Agent, or Firm*—John Wiley Horton

(57) ABSTRACT

A method and device for securing a tee shirt to a bra. The device is an elongated fabric strip with a first fastener on one end and a second fastener on the other end. The fasteners are preferably of the hook and loop type. They are positioned so that when the elongated fabric strip is curled into a loop, the first and second fasteners can be attached to maintain the fabric strip in the loop. The method for applying the device is as follows: The lower portion of the tee shirt is passed under the center web of the bra, then back out through the neck opening. The present device is then looped around the looped portion of the tee shirt. The hook and loop fasteners are pressed together to secure the tee wrap. In that state it securely attaches the tee shirt to the bra.

5 Claims, 6 Drawing Sheets

METHOD AND APPARATUS FOR SECURING A TEE SHIRT TO A BRA

CROSS-REFERENCES TO RELATED APPLICATIONS

Not Applicable.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of clothing. More specifically, the invention comprises a method for securing a tee shirt to a bra so that the tee shirt remains in a desired position.

2. Description of the Related Art

FIG. 4 shows a wearer 22 wearing a prior art tee shirt 20. Tee shirt 20 has neck opening 24 (which may take many shapes) and lower portion 26. It may display printed matter, embroidered patterns, or other decorations known in the field.

Women often wear a bra 28 beneath tee shirt 20. Bra 28 has center web 30, among other features. In warmer climates, women sometimes prefer to wrap a portion of the tee shirt around the bra. FIG. 5 shows this arrangement. The wearer has tucked lower portion 26 back up under center web 30 and wrapped it around center web 30. This arrangement exposes the midriff and radically alters the appearance of the tee shirt. Unfortunately, however, the tee shirt does not tend to remain in this position. Some wearer's may knot the looped portion of the tee shirt in place, but this produces a thick and uncomfortable cross section near the wearer's sternum. Thus, the prior art solution has undesirable limitations.

BRIEF SUMMARY OF THE INVENTION

The present invention comprises a method and device for securing a tee shirt to a bra. The device is an elongated fabric strip with a first fastener on one end and a second fastener on the other end. The fasteners are preferably of the hook and loop type. They are positioned so that when the elongated fabric strip is curled into a loop, the first and second fasteners can be attached to maintain the fabric strip in the loop.

The method for applying the device is as follows, with reference to FIGS. 4, 5, and 6. The lower portion 26 of tee shirt 20 is passed under the center web 30 of bra 28, then back out through neck opening 24. Lower portion 26 is thereby looped around bra 28, as shown in FIG. 5. Tee wrap 10 is then looped around the looped portion of the tee shirt. The hook and loop fasteners are pressed together to secure tee wrap 10 in the position shown in FIG. 6. In that state it securely attaches the tee shirt to the bra.

REFERENCE NUMERALS IN THE DRAWINGS

Figure 1:
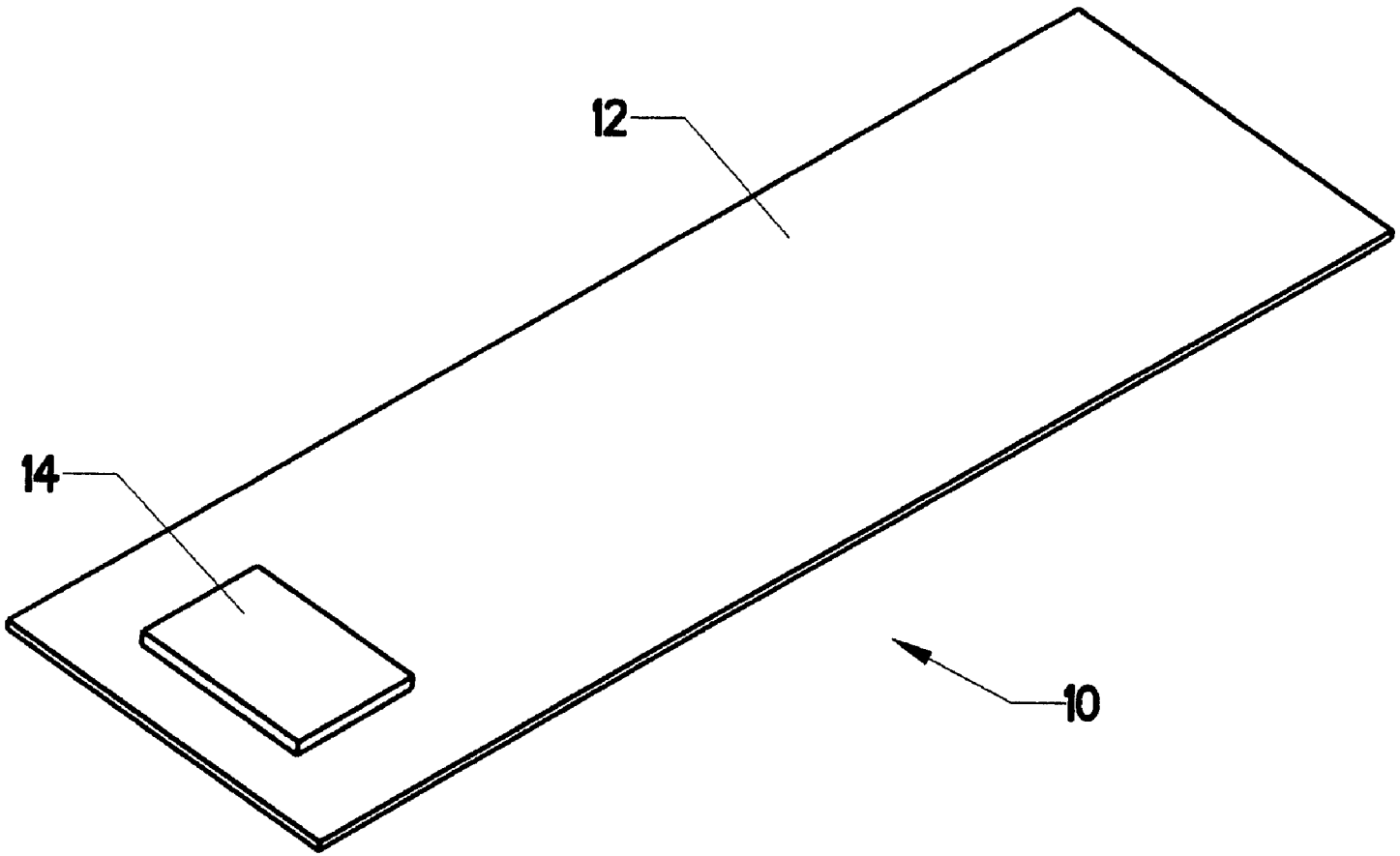
FIG. 1 is a perspective view, showing the present invention.

10 tee wrap 12 fabric strap
14 first fastener 16 second fastener
18 adjustment break 20 tee shirt
22 wearer 24 neck opening
26 lower portion 28 bra
30 center web

DESCRIPTION OF THE INVENTION

Figure 2:
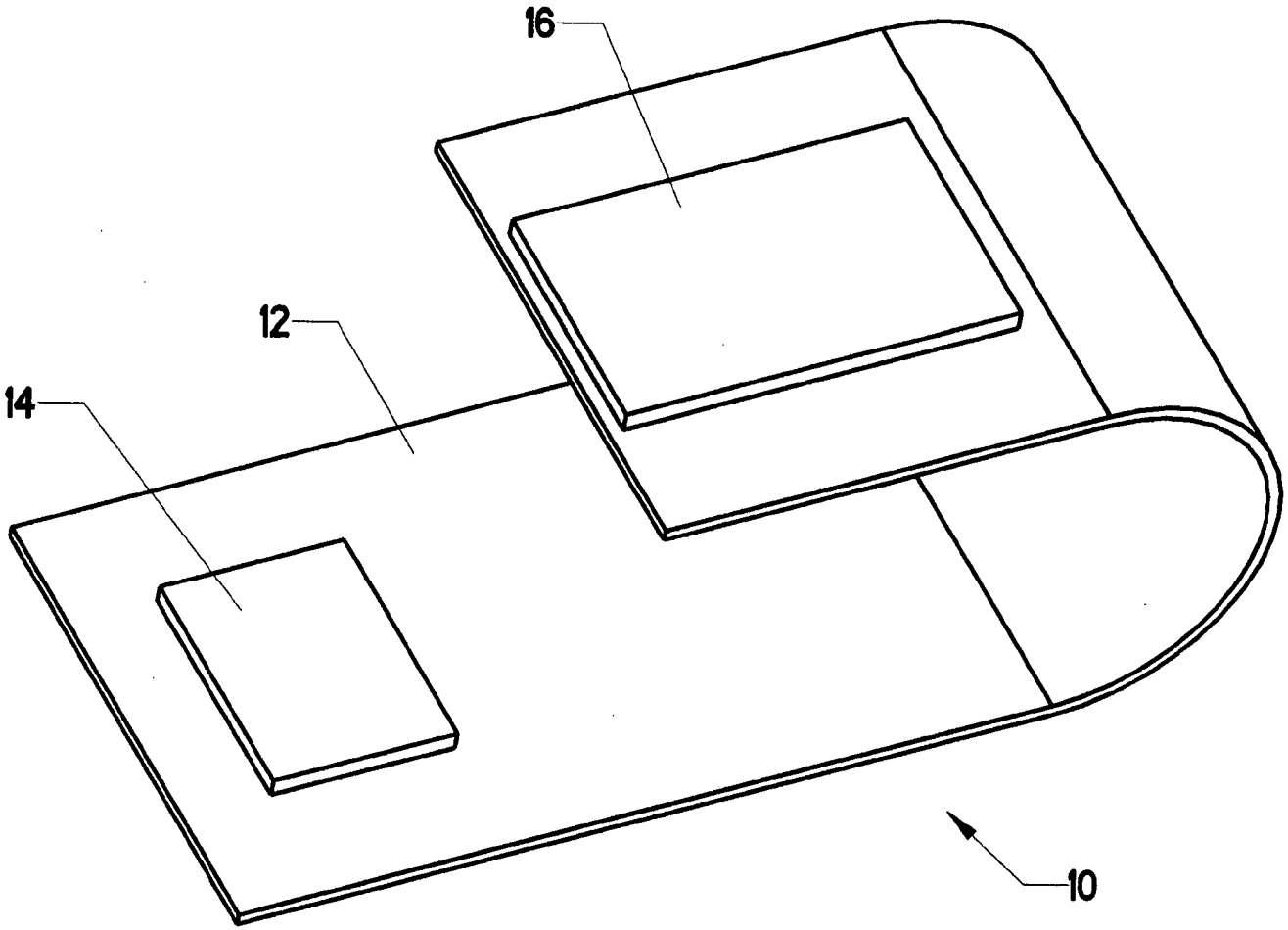
FIG. 2 is a perspective view, showing both sides of the present invention.

FIG. 1 shows tee wrap 10. An elongated fabric strip 12 is its primary component. Fabric strip 12 has a first side facing the viewer and a second side facing away from the viewer. It also has a first end and a second end. First fastener 14 is located on the first side proximate the first end. A corresponding second fastener 16 is located on the second side proximate the second end. FIG. 2 shows tee wrap 10 in a curled state, so that the user can see both first fastener 14 and second fastener 16 at the same time.

Figure 3:
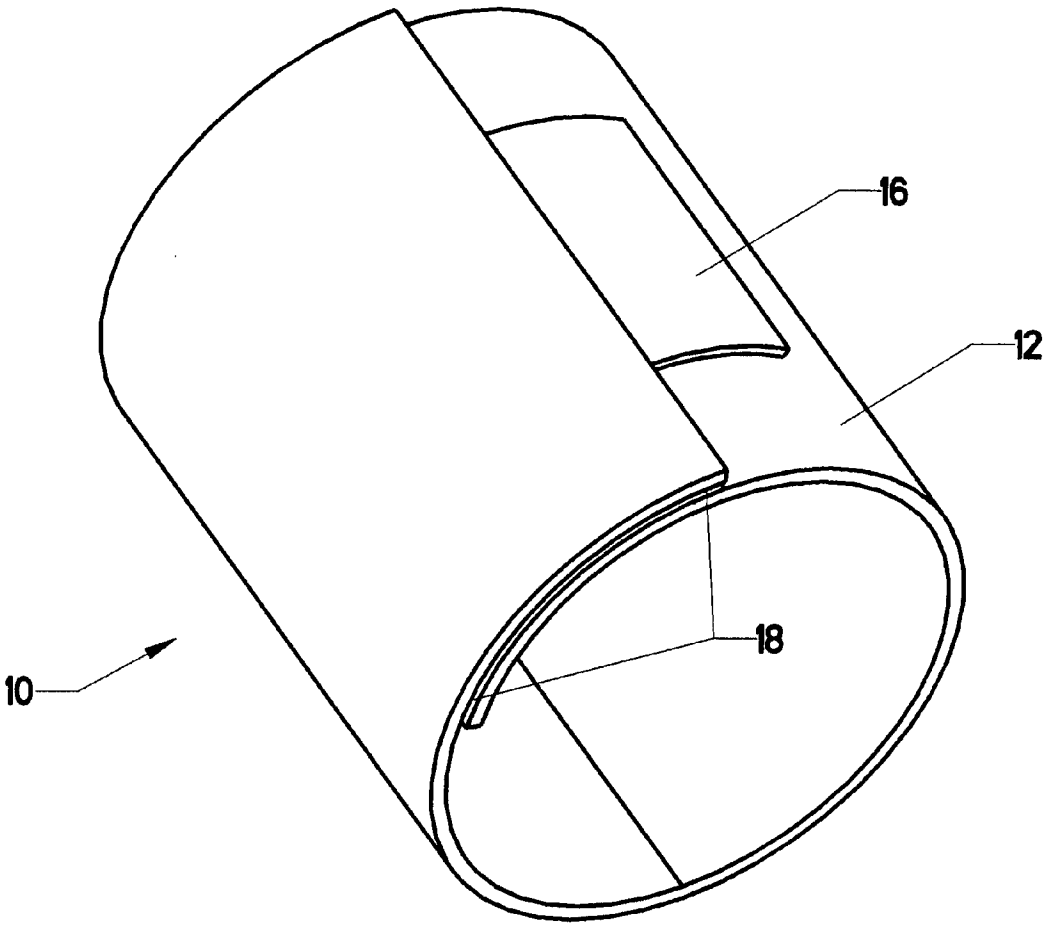
FIG. 3 is a perspective view, showing the tee wrap in a curled state.

In use, tee wrap 10 is curled to form a loop. FIG. 3 shows tee wrap 10 curled into a loop. First fastener 14 and second fastener 16 are preferably of the hook and loop type, so that they stick to each other when pressed together (One hook and loop type of fastener is sold under the trade name VELCRO). The two fasteners have been pressed together in FIG. 3. The surface area of the two fasteners is large enough to allow the user to adjust the diameter of the loop formed by adjusting the overlap between the first and second ends of fabric strip 12. This adjustment is designated as adjustment overlap 18 in FIG. 3. Those skilled in the art will realize that if the overlap is increased, the diameter of the loop formed will be reduced.

Figure 4:
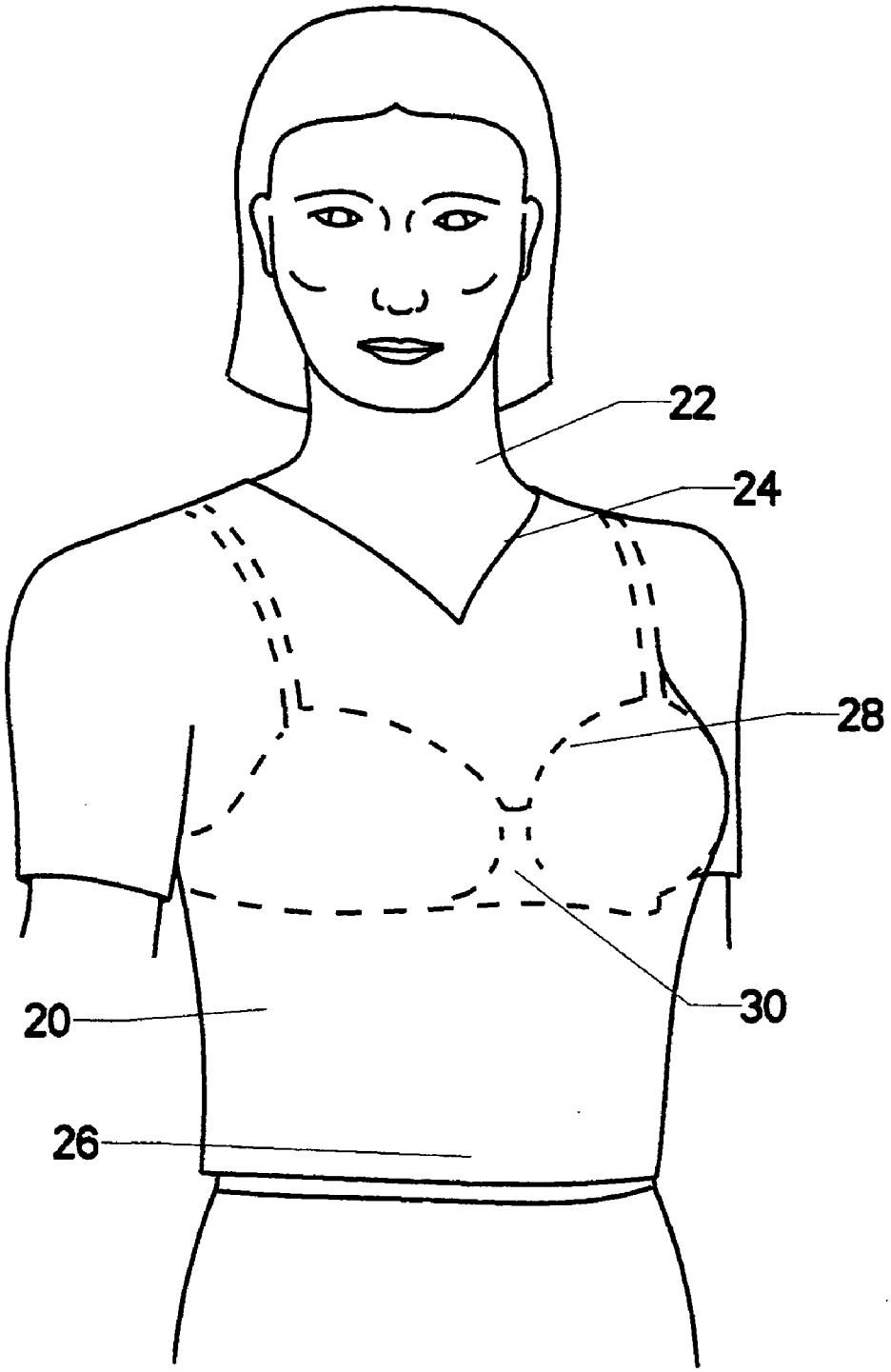
FIG. 4 (PRIOR ART)
FIG. 4 is a perspective view, showing a prior art tee shirt.
Figure 5:
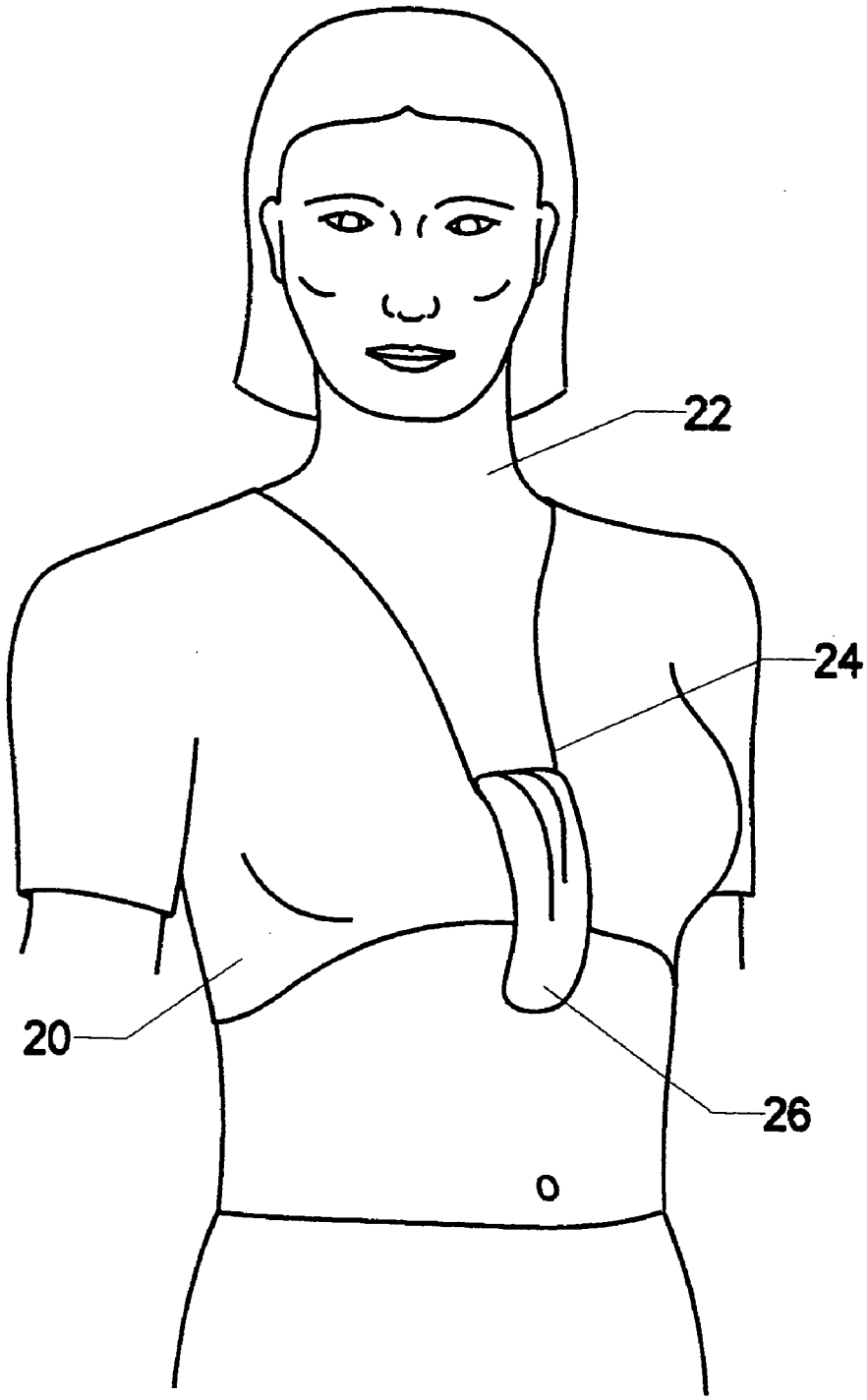
FIG. 5 (PRIOR ART)
FIG. 5 is a perspective view, showing a prior art tee shirt wrapped around the wearer's bra.

FIGS. 4 and 5, as explained previously, depict the process of looping lower portion 26 of tee shirt 20 behind center web 30 to form a first loop as shown in FIG. 5. In order to affix the tee shirt to the bra, the user slips fabric strip 12 behind both the center web and the tee shirt, then loops it around both the center web and the tee shirt to form a second loop. The user then adjusts the size of the second loop to preferably compress the looped portion of the tee shirt against the center web. The user then secures tee wrap 10 in position by pressing first fastener 14 against second fastener 16, resulting in the configuration shown in FIG. 6. By adjusting adjustment overlap 18, the user can create a smaller or larger loop.

The width of fabric strip 12 can be varied considerably. When tee wrap 10 is installed, a wider fabric strip will expose more of the bust line, while a narrower fabric strip will expose less of the bust line. It is therefore advantageous to provide fabric strips of varying widths, so that the user can select one providing the desired effect.

The term "fabric strip" is intended to include any flexible and relatively thin material. Examples include NYLON, cotton cloth, thin plastic, and even thin metal foils. Similarly, the term "fastener" is intended to encompass any type of known fastener. Although the hook and loop type has been illustrated, snaps, buttons, or other similar devices could be used.

Figure 6:
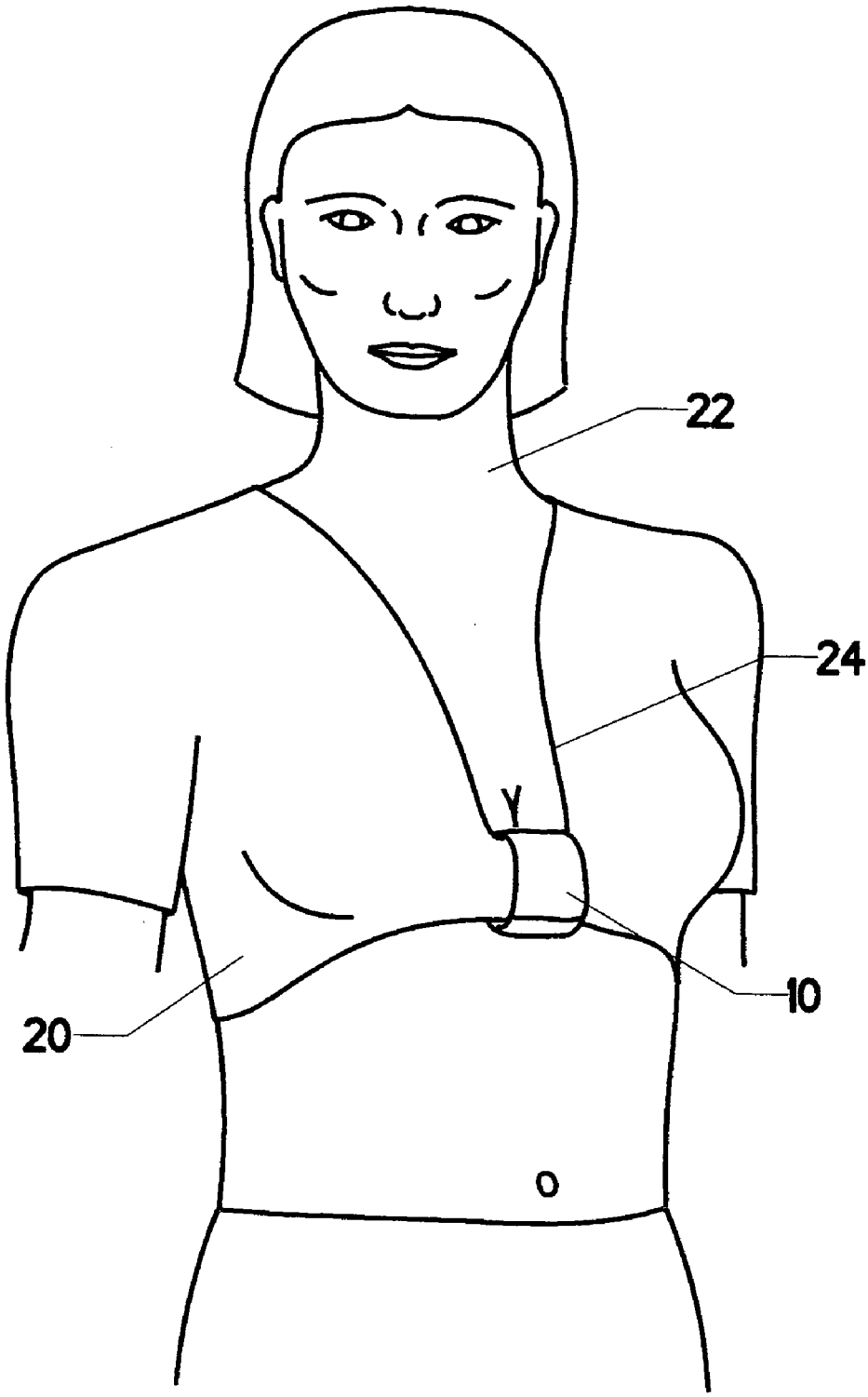
FIG. 6 is a perspective view, showing the tee wrap wrapped around the wearer's tee shirt and bra.

The reader will observe, with reference to FIG. 6, that a substantial portion of fabric strip 12 is exposed for viewing when tee wrap 10 is in place. It may therefore be desirable to decorate fabric strip 12 with printing, beads, or any other known stylistic device. As an example, it is possible to customize the device by printing the wearer's name or initials on the exposed portion of the loop. The wearer can also color-coordinate her apparel by selecting colors for the fabric strip which coordinate with the color of her tee shirt.

The preceding description contains significant detail regarding the novel aspects of the present invention. It is should not be construed, however, as limiting the scope of the invention but rather as providing illustrations of the preferred embodiments of the invention. Thus, the scope of the invention should be fixed by the following claims, rather than by the examples given.

Having described my invention, I claim:

1. A method for securing a tee shirt to a bra, wherein said tee shirt has a lower portion and a neck opening, and wherein said bra has a center web, comprising:

a. providing a tee wrap comprising a fabric strip with a first end and a second end, a first side and a second side, a first fastener on said first side proximate said first end, and a second fastener on said second side proximate said second end;

b. pulling said lower portion of said tee shirt behind said center web of said bra and through said neck opening of said tee shirt so that said lower portion of said tee shirt forms a first loop around said center web of said bra;

c. looping said tee wrap around said first loop formed by said lower portion of said tee shirt to form a second loop lying outside said first loop; and d. fastening said second fastener to said first fastener, so that said tee wrap binds said first loop formed by said lower portion of said tee shirt to said center web of said bra.

2. A method as recited in claim 1, wherein said first and second fasteners comprise cooperating strips of hook and loop fastener fabric.

3. A method as recited in claim 2, wherein said first and second fasteners are large enough to allow the diameter of said second loop to be adjusted.

4. A tee shirt and tee wrap assembly comprising:

a. a bra having a center web;

b. a tee shirt having a lower portion and a neck opening;

c. a fabric strip with a first end and a second end, a first side and a second side;

d. a first fastener on said first side of said fabric strip proximate said first end;

e. a second fastener on said second side of said fabric strip proximate said second end; and f. wherein said fabric strip of said tee wrap wraps under said lower portion of said tee shirt, behind said center web of said bra, and through said neck opening of said tee shirt and said first fastener and said second fastener are fastened together.

5. A tee wrap as recited in claim 4, wherein said first and second fasteners comprise cooperating strips of hook and loop fastener fabric.

* * * * *